United States Patent [19]

Cole et al.

[11] 4,428,285

[45] Jan. 31, 1984

[54] OSCILLATORY BAND AND HAMMER DOT MATRIX PRINTER

[75] Inventors: Norman F. Cole, Raleigh; William D. Thorne, Wake Forest, both of N.C.

[73] Assignee: International Business Machines Corp., Armonk, N.Y.

[21] Appl. No.: 378,557

[22] Filed: May 17, 1982

Related U.S. Application Data

[63] Continuation of Ser. No. 167,181, Jul. 9, 1980, abandoned.

[51] Int. Cl.[3] ..... B41J 3/12; B41J 1/20

[52] U.S. Cl. ..... 101/93.04; 101/93.14; 400/121; 400/146

[58] Field of Search ..... 101/93.04, 93.05, 93.14, 101/111; 400/121, 124, 146

[56] References Cited

U.S. PATENT DOCUMENTS

| | | | |
|---|---|---|---|
| 3,605,613 | 9/1971 | De Puy et al. | 101/111 |
| 3,793,951 | 2/1974 | Denley | 400/146 X |
| 3,884,148 | 5/1975 | Bergeron | 400/130 X |
| 3,960,074 | 6/1976 | Chou | 101/111 X |

FOREIGN PATENT DOCUMENTS

| | | | |
|---|---|---|---|
| 2525528 | 12/1976 | Fed. Rep. of Germany | 400/121 |
| 7507826 | 1/1976 | Netherlands | 400/124 |
| 1344295 | 1/1974 | United Kingdom | 101/111 |
| 1493719 | 11/1977 | United Kingdom | 101/93.04 |

*Primary Examiner*—Paul T. Sewell
*Attorney, Agent, or Firm*—Edward H. Duffield

[57] ABSTRACT

Described, is a printing mechanism allowing full exploitation of the potential of dot matrix printing. Dot forming elements are mounted on a carrier for transport past an array of hammers located in front of media to be marked upon. The dots or carrier are impacted by the hammers to form dots on the medium. By appropriate control of motion of the printing medium and timing of the hammer impacts, a dot may be formed anywhere on the surface of the medium. This allows unlimited character font set generation as well as special character printing for enlarged font, miniaturized font, fast rough draft copy printing, the printing of ascenders and descenders for characters and for condensed or compacted printing. In addition, the mechanism permits an all points available graphics generation system and full control for variable vertical spacing of printed elements and of variable horizontal spacing of the printed elements. Variable print element shapes, grey tone graphics printing and multi-color additive or subtractive color processes are also facilitated. To improve the throughput speed, a reversible motor is used for driving the dot element carrier and a plurality of dot font sizes and shapes are provided on the carrier. By selection of the required font size and shape and by comparison with the presently known position of the carrier, the quickest access to the next desired dot font for any given hammer can be achieved.

1 Claim, 8 Drawing Figures

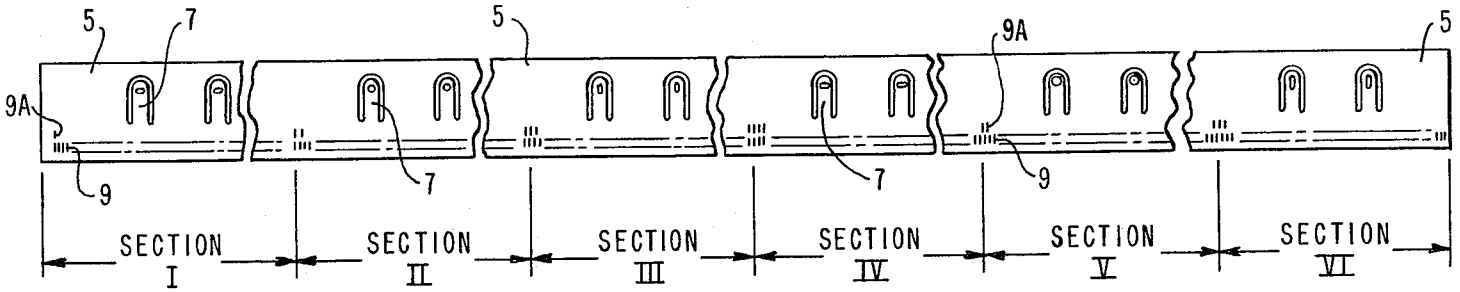
FIG. 2
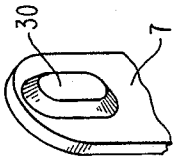
FIG. 3A
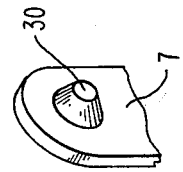
FIG. 3B
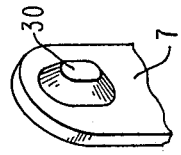
FIG. 3C
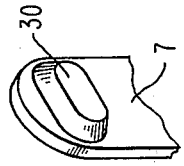
FIG. 3D
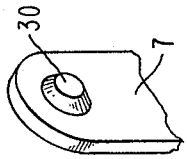
FIG. 3E
FIG. 3F

OSCILLATORY BAND AND HAMMER DOT MATRIX PRINTER

RELATED APPLICATION

This is a continuation of application Ser. No. 167,181 filed July 9, 1980, abandoned.

This invention describes improvements over the basic invention described in a copending application Ser. No. 135,803, now abandoned assigned to the common assignee herewith.

FIELD OF THE INVENTION

This invention relates to impact printing and matrix printing mechanisms and apparatus of the dot forming type in general. In particular, it relates to the hammer and marking element type of printers of this class in which the marking element carrier may be reversed or oscillated in the direction of travel relative to the hammers to more quickly position a desired area of the marking element adjacent to a desired hammer.

PRIOR ART

A variety of dot matrix printers are known in the prior art. For example, many so-called dot matrix print heads exist in which one or more wires or elongated dot forming elements may be projected forward under appropriate control to impact a ribbon and drive it against a medium to be marked upon. Appropriate systems for relative movement between the print head and the medium are known. Such general mechanisms of this class are numerous and have been widely adapted for use and currently enjoy a high level of success. These so-called wire matrix print heads and the mechanisms employed in them suffer, however, from many inherent difficulties. First, it is necessary to translate the entire print head back and forth along a line of printing or to move the paper in order to cause relative motion between the two to occur. Mechanisms for horizontal translation of print heads back and forth in a repetative and precisely controlled manner are expensive and relatively difficult to build and maintain. The mass of the number of hammers in the print head limits the through put due to the turnaround time required. A variety of problems can exist when such mechanisms are out of proper adjustment. Such problems may cause distortion of or failure to create the desired printed images. The general configuration uses a vertical array of print wires which limits the vertical dot placement and causes poor utilization of hammers dedicated to decenders. This also causes uneven wear of hammers due to usage. In addition, the failures of one or more wire elements may make themselves known by distortion of virtually all of the printed material which follows the failure. The inherent limitations of devices of this type include those of relatively limited speed of printing. Printing speeds in the range of only 80 to 300 characters per second with a single print head of this type are within the broad general bounds and limitations of the present technology of this sort.

Another general class of dot matrix printers comprises the so-called bar and helix or bar and element intersectional impact printers. In these devices, a moving raised ridge or print element passes behind a sheet of paper to be marked upon and is impacted by a hammer impacting the paper against element at a carefully controlled time to create a dot of the approximate size and shape of the intersectional area between the hammer and the print element. Such printers may be utilized either as serial character printers or line printers where a number of hammers may be simultaneously employed in creating dots for the formation of characters or images. In printers of this latter type, extremely accurate control of the timing of the hammer impact relative to the exact location of the moving print element must be maintained. A variety of designs exist and devices of this character have been widely used to good effect. However, numerous difficulties with this type of design do exist. For example, the print element character is often a precision machined metal drum with raised ridges upon it is used as one-half of the dot element intersection former device. The raised ridges must be very carefully spaced and dimensioned in profile in order to perform appropriately to provide high quality, carefully controlled placement of the resulting dot marks on the medium. Imaging and shadow printing occur with this technology. It limits the forms thickness and number of copies that can be made without distortion. The paper movement to cause printing produces accoustical noise which is difficult to suppress. Wear, misalignment and other mechanical and physical effects may cause rapid deterioration of the printing quality in such a system and the expense of the dot forming device is considerable. In addition, the shape of the dot produced is inherently limited to that of the intersection between the moving raised ridge and the hammer pace. These devices do offer generally higher printing speeds, however, and speeds in the range of 100 to 600 lines per minute may be generally attainable with this technology.

A specific example of this type is shown by U.S. Pat. No. 4,068,583 wherein the dot elements are formed at the intersection between a generally horizontal hammer and a generally vertical raised ridge or element carried on a belt or band. Appropriate paper and marking medium are interposed between the moving belt and a hammer and an impact between a raised ridge on the belt and the hammer creates an intersectional dot, a plurality of which may be created through appropriate timing of the hammer impacts with the moving belt and motion of the paper to form any desired characters. The shape and form of the resulting dots is, however, limited to the intersectional area between the moving print element and the face of the print hammer so that wear on one or more print hammers and/or print elements may be apparent in the resulting print quality of many print characters. This design, however, does avoid the use of an expensive drum carrying the raised print element ridges.

OBJECTS OF THE INVENTION

In view of the foregoing inherent difficulties or inadequacies in the known prior art, it is an object of this invention to provide an improved, more flexible and generally useful dot matrix printer which carries a plurality of dot font styles on a single, reversibly driven carrier and which is both of relatively low cost and high speed and which does not suffer from the aforementioned difficulties to the extent or of the type noted.

It is a further object to provide an improved dot matrix printing technology which permits easy variation of the shape or form of the dots to be generated and easier, faster access thereto on the dot font carrier in a fashion which is compatible with the requirements of a variety of useful dot matrix printing features such as:

unlimited character font sets, special character printing for enlarged font, miniature font, rough quality draft font, full ascender and decender capability, condensed or compacted printing, full all points available graphic display, full variable vertical and horizontal spacing of print elements and full variation of print element shape, grey tone graphic quality, dot location and which is effective for either multicolor additive or subtractive color printing techniques.

SUMMARY

As shown in the aforementioned copending application, the primary functional components for the dot matrix printer embodied according to the present invention are a movable print element carrier belt, which may be a continuous loop of material provided with fingers or other movable print elements each of which has two faces, and at least one print hammer. One face of the print element has a hammer impact face which may be struck by the print hammer. The other face of the element carries a dot or other form of raised character element forming shape. A plurality of different dot sizes and shapes may be on the carrier belt of the improved printer described herein. Reversible band driving means are included to reduce the access time for positioning a given dot font area of the carrier beside a given hammer by driving the carrier in the direction requiring the least translation of the carrier. The movable print elements are located on a belt or band in such a fashion that any hammer actuator operation will contact only a single element and cause only that associated element to contact a ribbon to force it against the paper making a mark of the form of the dot or print element on the face of the element. The paper is supported by a platen and the appropriate controls for motion of the paper either in the vertical or horizontal direction are included. By appropriate timing and reversal or oscillation of the direction of band travel by selecting the direction of motor rotation and by the timing of the impact between the moving print element carrier and the print hammers, a dot or mark of any desired shape according to the shapes provided on the moving band or belt can be formed anywhere on a fixed or moving sheet of paper.

BRIEF DESCRIPTION OF THE DRAWINGS

FIG. 2 illustrates an elevation view of a cut and flattened out print element carrier belt having various dot font size and shape elements in various sections along the length thereof.

FIGS. 3A–3F illustrate various font element sizes and shapes that may advantageously be used with a given belt such as that shown in FIG. 3.

SPECIFICATION

Figure 1:
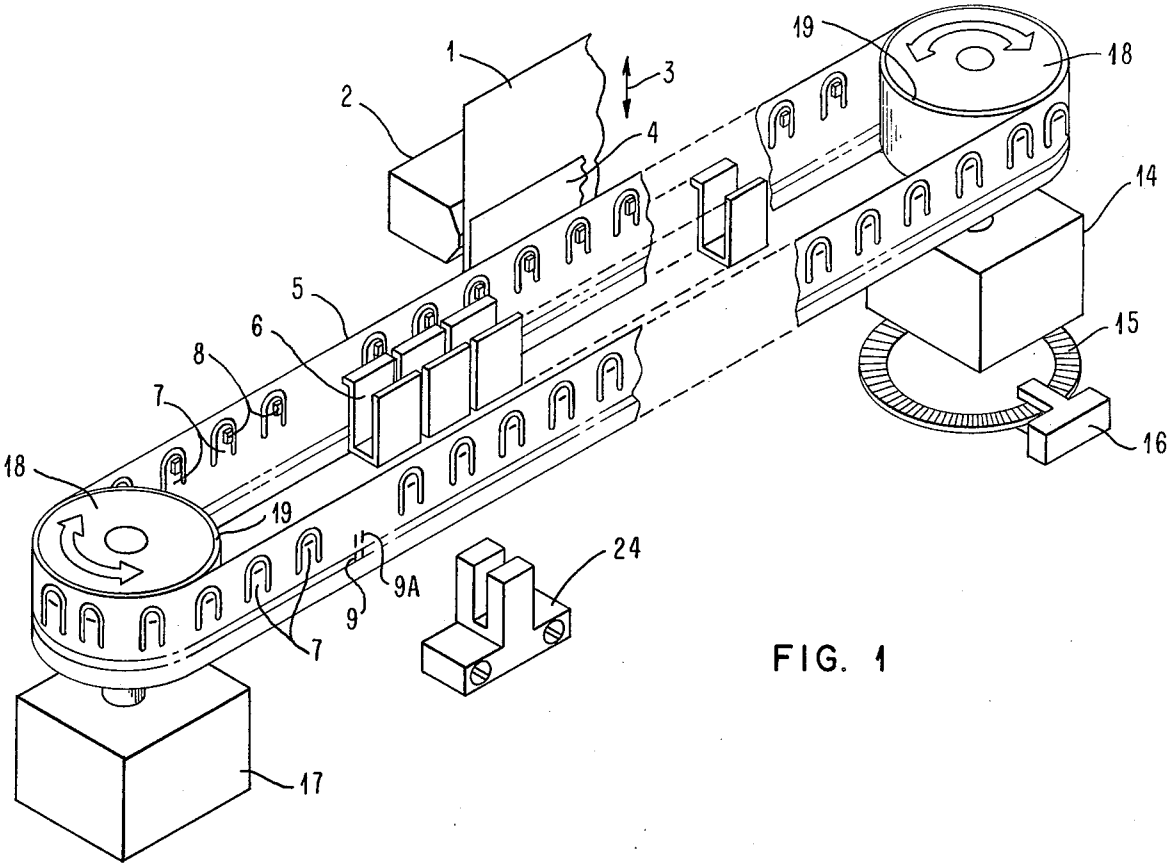
FIG. 1 illustrates the primary functional elements of a preferred embodiment of the present invention in a pictorial representation showing how they may be employed.

Turning to FIG. 1, a preferred embodiment of the present invention is shown in a pictorial and schematically representative form with the essential elements required being briefly depicted. In FIG. 1, the paper or media 1 to be marked upon is shown together with an appropriate platen 2. A paper motion drive means for moving paper 1 in the direction of arrow 3 would also be included but is not shown. Paper 1 may be moved either continuously or intermittently as is generally known in the art and it may be understood that the vertical spacing of the dot elements is primarily controlled by the degree of motion provided in indexing the paper from one dot row to the next and that spaces between characters in the vertical direction are created by advancing the paper further than for the formation of characters or for the formation of rows of dots to form characters. An appropriate ribbon 4 is interposed in front of the paper 1 and may be supported and driven by means not shown in FIG. 1.

A movable belt or band 5 is one of the principle elements of the present invention and it is interposed in front of the ribbon 4 in a position separated from both the paper 1 and ribbon 4 and adjacent to, but separate from a bank of one or more impact hammers 6. The belt or band 5 may contain one or more print element dot forming means. These are generally shown as a movable or flexible finger 7 integrally formed with belt 5 and carrying an anvil or impact face on its backside shown as 8 in FIG. 1. It will be understood that the opposed face of each anvil 8 contains a raised projection in the appropriate plan or form to provide a dot of the desired shape on paper 1. This occurs when the anvil 8 is struck by one of the hammers 6 to deflect the finger 7 and impact the print element against the ribbon 4 and paper 1.

As shown, each flexible finger 7 on the carrier belt 5 is integrally a part of band or belt 5 at the point of attachment at the base of each finger 7. Fingers 7 may also be non-integral with belt 5, but attached thereto by rivets or other suitable means.

A plurality of timing marks or slots 9 are shown on band 5. As is generally understood in the art, either optically transparent slots or magnetic reluctance or mechanically sensible marks may be made on a belt or band 5 in order to appropriately time the motion, velocity and direction of the belt 5 past the hammer array 6. Additional marks 9A are shown for use in identifying the start and end of each of the various dot font size and shape areas on the belts.

Although it is not shown, it will be appreciated by those of skill in the art, the paper tractor or moving means may take a variety of forms including friction wheel drive, reel-to-reel drive of a continuous paper form, perforated form tractor means or suitable moving bed or platen drive means for advancing the paper. A variety of optical or mechanical emitters may be connected with the paper drive means to accurately gauge the degree of motion produced so that the vertical spacing of dot elements and characters eventually produced can be accurately controlled.

Similarly, the platen 2 will be understood to be schematic in representation only. Round or rotating platens of any desired material or shape can advantageously be employed according to the specific requirements of the paper medium 1 and the dot forming elements and ribbon elements. Likewise ribbon 4 may be an inked ribbon or a carbon film transfer type of ribbon or any of a variety of suitable ink or marking material carrying means for either additive or subtractive color formation. Ribbon 4 is indicated as generic in form only since it would be well understood in the art that numerous colors can be provided in bands or stripes on a given ribbon 4 and that various technologies for constructing a suitable ribbon 4 that provides the desired type of transfer of marking material to the surface of the paper by impact between them are known. The ribbon may be dispensed with and entirely eliminated if self-marking impact sensitive paper well-known in the art is utilized.

A bank of one or more hammers 6 is generally indicated as hammer bank 6. It is intended to encompass all of the individual hammers 6 that may be contained within it and is shown generally in FIG. 2 positioned on one side of the moving belt or band 5. The suitable marking ribbon 4 and paper 1 are interposed on the other side of the belt or band 5 with the paper 1 supported on a platen 2 as generally indicated.

A belt and ribbon drive motor 14 is generally indicated in FIG. 1.

An optical or magnetic position emitter sensor 24 is generally shown in FIG. 1 with belt or band 5 passing between the two halves of the sensor 24. Sensor 24 may be either optical or magnetic and will operate based on the emitter markings or apertures 9 or 9A as shown in FIG. 1 which are placed on belt or band 5 as previously described. For example, if marks 9 or 9A on belt 5 are optically transmissive slots, sensor 24 may comprise sources of light and photo cells interposed on opposite sides of the moving band or belt. These will produce electrical pulses varying in amplitude according to the presence of an optically transmissive or opaque portion of belt or band 5 passing through the sensor. The resulting electrical signal train may be appropriately shaped as a string of pulses for timing or counting. By this means the relative position of any of the movable print elements and dot font type areas on the belt relative to some fixed position for the various print hammers 6 may be accurately defined.

A printing operation generally as depicted in FIG. 1 is performed as follows:

For maximum throughput, it is desirable that there be as many print hammers 6 as there are print element fingers 7 across the length of the print line on paper 1. At appropriate positions across the length of the print line, the individual hammer actuators 6 will be caused to operate as previously described to impact the anvil surfaces 8. This will be done at appropriate individual timings to create a series of dots along the print line at the appropriate spacing for partial creation or completion of one or more desired characters or shapes. It will be understood that the dots that are created will be in the exact form and shape of the faces of dot print elements 30 on the opposite sides of the anvil faces 8.

The width of the individual hammers 6 is conveniently chosen to be an integral number of character widths, at least one, and perhaps 2 or more to reduce the expense of hammer mechanisms. It will be understood that the number of hammers 6 will be dependent upon the repetition rate at which the individual hammers may be operated and upon the general throughput of printing that is required.

The translational direction and velocity with which belt or band 5 is driven and which controls the rate of movement of the print elements across the print line is dependent upon the hammer impact repetition rate and upon the print element spacing desired on the resulting image.

When all of the desired print positions along a given print row in the print line have been provided and each of the print hammers has been fired at the appropriate number of times and places to create the dots, paper 1 will be moved to the next desired row position and the printing operation will be repeated. It will be understood that the operations can cause any print format to be printed under program control and that the vertical printed element spacing can be controlled by the degrees of rotation of the paper feed motor or mechanism (not shown in FIG. 1).

Turning to FIG. 2 a print belt or band 5 is illustrated in greater detail in a pictorial view. It may be appreciated that provision may be made for an individual user or customer to change either or both the shape or size of the dot elements utilized in the printer by programming control over which dot font elements are struck. Also printing belts or bands 5 of this type will not be as expensive or complex as printing drums or other precision formed devices generally used in the art. For example, if large character printing is desired, dot print elements having larger diameter dots, for example 0.025" diameter dots, can be used. However, when, contrary to this requirement high quality printing with very close dot spacing is required, a dot element of approximately 0.010" in diameter could be utilized at 0.005" spacing in both the horizontal and vertical directions to create a high density image in which the individual dots will partially overlap one another.

The benefits in the two examples given will be instantly apparent since enlarged printing can be accomplished with equivalent print density and appearance in the same manner as normal printing and with few, if any, more printing strokes being required. This will maintain both the throughput and hammer and ribbon lives. However, improved quality printing would be impractical with large dot sizes and hence, the selection of an area on the belt or of a belt or band with smaller dots on it would be appropriate.

Appearance improvement in the resulting characters can be created also by adjusting both horizontal and vertical spacings of the print elements as controlled by varying the timing and degree of motion of paper movement and timing of hammer impacts. For example, a vertical spacing of 0.01" and a horizontal spacing of 0.02" as used in some alphanumeric formats may have its appearance improved if the print elements are made oblong and approximately of the same general dimensions of 0.01" by 0.02". Equivalent to this would be the multiple impact of a smaller dot at each of two adjacent locations to partially overlap and create the appearance of an oblong dot, but this would greatly reduce throughput since perhaps double the number of hammer strikes would be required.

It will be readily appreciated that the print belt 5 could be mounted within a cartridge system to provide for a clean hands changing of the belt and for identification of the belt contained within it. Also, such cartridges may carry mechanical or electrical encoding means on them to inform a using system by actual insertion of the cartridge into it as to which type of programming or which type of dot elements are carried within it.

In FIG. 2, the belt or band 5 may be conveniently made of steel or stainless steel. Typical specifications are that the band be approximately 0.005" thick and approximately 1–2" wide (or wider as desired). The fingers 7 are integrally formed by machining, stamping or etching them to leave base portions attached to belt 5 as shown. Radiused ends on fingers 7, sloped faces on anvils 8 and the means of attaching dot elements 30 to fingers 7 opposite anvils 8 are all obvious to one of skill in the art as shown in the figures.

Flexible or spring fingers 7 formed in the belt or band 5 may have the individual pairs of anvil 8 and dot forming elements 30 connected to them through an aperture (not shown). They may be staked and swaged in place or welded as the case may be.

FIGS. 3A through 3F illustrate various print element font sizes and shapes that may be employed on the spring fingers 7 of belt 5 in FIG. 2. FIG. 3A shows a detail of a horizontally elongated or eliptical dot face element 30. FIG. 3B illustrates an approximately circular dot font element with a small diameter circle. FIG. 3C illustrates a vertically elongated or eliptical dot font shape. FIGS. 3D through 3F illustrate larger size font elements similar to the design of those in FIGS. 3A through 3C.

Returning now to FIG. 1, the drive motor 14 is controlled in speed and direction of rotation by a program control operating from pulses derived from another optical emitter system. An optical emitter disc 15 is affixed to the motor drive shaft and an optical source and sensor configuration 16, similar to the source sensor combination 24 for example, is shown. Suitable timing marks or apertures may be made in the emitter 15 for enabling the sensor 16 and an attached control system to determine the direction of rotation of the motor 14. In conjunction with the information coming from the emitter grids 9 and 9A, full control over the position, direction and location of the various font elements and font style element areas on the belt opposite the desired hammer 6 may be maintained at all times. Whenever a change in the horizontal print element spacing is required, the print element horizontal velocity should be adjusted in an inverse manner to maintain the desired printing quality. This can be easily controlled by using a stepper motor for motor 14 and varying the pulse rate for motor operation. The pulse rate can be varied in accordance with program control selecting the various dot font sizes and shapes for printing desired characters and desired positions on paper 1.

The belt or band 5 is securely mounted in tension between the drive motor 14 and a bearing block 17 and is supported by pulleys 18 having rubber capstan drive tire elements 19 as shown.

Throughput calculations for typical performance of the subject invention are determined as follows. The data required for computing the throughput is that the hammer repetition rate, band dot pitch or element to element spacing on the band, the desired printed dot pitch on paper and the paper motion time to index from row to row. A formula for throughput in lines per minute can be expressed as follows:

$$\frac{\text{BAND DOT PITCH}}{\text{BAND SPEED}} \times \frac{\text{\# DOT ROWS}}{\text{PRINTED LINE}} + \begin{matrix}\text{BAND TURNAROUND TIME*}\\ \text{or}\\ \text{PAPER MOTION TIME}\end{matrix} = \text{LINE PRINT TIME} \qquad \text{(F. \#1)}$$

$$\text{FOR } LPM = \frac{60}{\text{LINE PRINT TIME}} = \text{LINES PER MINUTE}$$

*whichever is greatest

For example, assuming that printing in an alphanumeric character set is utilized and that each of the hammers 6 spans two character positions and the intervening space between two adjacent characters, and utilizing a seven dot high by four, five, six, or seven dot wide character matrix with the following assumptions: hammer impact repetition rate is one millisecond, the band dot pitch is 0.2" plus an additional 0.04" of spacing to prevent contact of two adjacent anvils by a single hammer, desired print dot pitch of 0.02" and assumed paper indexing or band turnaround time of 5 milliseconds the band speed is as given by formula #2

$$\text{BAND SPEED} = \frac{\text{PRINTED DOT PITCH}}{\textit{HAM RR}} \qquad \text{(F. \#2)}$$

where Ham RR stands for "hammer repetition rate" The result will be approximately 20" per second under the present assumptions. The total paper motion time and band turnaround time for each line of print will be approximately 45 milliseconds and it will be observed that under these circumstances a throughput of 465 lines per minute will be easily obtained.

It will be instantly appreciated that the resulting throughput of printing will vary based upon the desired printing density of dots as controlled by the horizontal and vertical indexing or spacing of the individual dots and by the consideration of the number of dot rows included in each line of printed characters. For example, if there are 12 dot rows in each line and the band speed is approximately ½ the previous example rate in order to create double density in the horizontal direction, the horizontal print element spacing will be 0.01" and the resulting throughput will be approximately 172 lines per minute. Further decreases in throughput result as the horizontal print elements per line increase. Effectively, the number of hammer strikes required to generate all the dots on a given horizontal line are the controlling factor. As will be understood by those of skill in the art, if additive or subtractive color printing is required where individual dots of different colors must be overlaid, the effect will be approximately the same as generating higher density character formation by having more numerous hammer strikes in each horizontal line. The electronics will determine the shortest route to the desired band section for the element desired and the initial direction of travel. The rate of section selection travel could be 200 inches/sec. with 20 ms accell-decel time. The time for print element selection would be approximately 100 ms. It would be advantageous to provide forms back up to allow repetitive printing of the same print element to be printed in a sequence of lines, then returned to the required distance to cause printing with the newly selected print element. The time for print element selection could be overlapped with the forms back up.

The examples given are illustrative only. It will be apparent to those of skill in the art how easily and with what flexibility a wide variety of font appearances may be generated using this technology. Obviously an infinite variation of dot element face geometries exist. Circular, elliptical, rhomboidal, hexagonal or any other shapes could be used or even intermixed on the same belt for varying effects. These shapes can be interspersed around the length of the band and, by appropriate timing control, the shortest translational path to the next desired dot font size or shape in front of any given hammer can be easily achieved. Thus, the reversible motor drive mechanism for the carrier band in combination with the various font sizes and shapes can provide a wider range of functions as previously noted.

As shown in FIG. 2, the various dot font sizes and shapes may be grouped together in a section of the belt and other dot font sizes and shapes may be grouped together in other areas of the belt. Then, for quickest access to a given desired font size and shape, the band travel may be reversed or driven forward as necessary to position the desired dot element in front of any given hammer. This oscillatory band drive can be shown to improve throughput as follows.

If we assume two dot sizes are required (emphasized characters or border lines), it may take as many as four passes of a small dot size for the stroke width and height that is desired. The ability to position the desired dot size element would reduce the number of hammer impacts to 25% of the original number for rows containing only the emphasized characters or lines. The throughput for this case would be improved by approximately four times. A mixture of dot sizes would have a throughput improvement that is an inverse function of the basic throughput; the lower the basic throughput the greater the improvement. If the print time per row is 60 ms and the paper feed times is 5 ms, the times would be 60 ms$\times$4 (print time)+5 ms (paper feed time) vs. 100 ms (oscillate time)+2$\times$60 ms (print time) for a 10% throughput improvement even under this condition.

Additional benefits are power reduction, noise reduction and reduced heating of hammer assembly, as well as improved hammer life due to fewer impacts required.

Having thus described my invention, what I claim as new and desire to secure by Letters Patent is:

1. A dot matrix printing apparatus for printing dots along a desired printing line on a recording paper, comprising:

a platen, said platen extending at least along the desired printing line;

a movable dot font element carrier adjacent to said platen and generally parallel thereto, said carrier traversing the desired printing line;

a plurality of dot font elements in a plurality of sizes connected to said carrier on a surface thereof facing said platen, said dot font elements being spaced apart from each other by at least a first width, said first width being measured along the desired printing line;

a reversible driving means engaging said dot font element carrier for moving said carrier at a predetermined velocity in either direction parallel to said platen to cause said carrier and said dot font elements to traverse the desired printing line in either direction;

at least one impact hammer adjacent to said dot font element carrier and so positioned that said dot font element carrier passes between said impact hammer and said platen, said impact hammer having an impact face width measured along the desired printing line which is at least an integral number of widths of characters in any desired matrix printing format, said impact face width being less than said first width of spacing between said adjacent dot font elements on said carrier;

hammer actuator means connected to said impact hammer for actuating said impact hammer to impact said dot font element carrier each said impact driving at least a portion of said carrier and a said dot font element thereon toward said platen;

timing means connected to said hammer actuating means for timing said impact to occur when a said font element of the desired size is adjacent to a portion of the desired printing line where a printed dot is desired;

means for shifting said paper in a direction generally orthogonal to the desired printing line;

a series of machine-sensible, regularly spaced timing and font size indicating indicia on said font element carrier; and a sensor for said indicia, said sensor being mounted in a fixed position adjacent to said dot font element carrier for sensing said indicia and developing timing signals for use in actuating said hammers.

* * * * *